US005742961A

United States Patent [19]

Casperson et al.

[11] Patent Number: 5,742,961

[45] Date of Patent: Apr. 28, 1998

[54] RECTAL AREA HYGIENE DEVICE

[76] Inventors: John L. Casperson, 23010 Lake Forest Blvd., Unit D162, Laguna Hills, Calif. 92653; Robert Ozeran, 11580 Sunset Blvd., Los Angeles, Calif. 90049

[21] Appl. No.: 773,077

[22] Filed: Dec. 26, 1996

[51] Int. Cl.[6] ..... A47K 3/22

[52] U.S. Cl. ..... 4/615; 4/601; 4/443; 4/448; 239/562; 239/583; 137/625.33

[58] Field of Search ..... 4/601, 615, 604, 4/605, 443, 448; 239/583, 562; 137/625.38, 625.3, 625.33

[56] References Cited

U.S. PATENT DOCUMENTS

| | | | |
|---|---|---|---|
| 671,958 | 4/1901 | Havard et al. | 239/562 |
| 1,140,462 | 5/1915 | Johnson | 239/583 |
| 3,072,345 | 1/1963 | Lennon | 239/583 |
| 3,212,719 | 10/1965 | Di Corpo | 239/562 |
| 3,512,525 | 5/1970 | Crowley, Jr. et al. | 4/448 |
| 3,670,966 | 6/1972 | Korda | 239/583 |
| 4,000,742 | 1/1977 | DiGlacomo | 4/448 |
| 4,287,618 | 9/1981 | Silver | 4/448 |
| 5,295,274 | 3/1994 | Daniels et al. | 4/443 |
| 5,409,167 | 4/1995 | Borod | 239/562 |

*Primary Examiner*—Charles R. Eloshway
*Attorney, Agent, or Firm*—Roy A. Ekstrand

[57] ABSTRACT

A conventional shower head is fitted with a tee fitting having a flow through passage and an additional tee passage within which a valve and control handle are supported. A flexible hose is coupled to a head assembly which includes an elongated handle and an elongated spray head. The handle defines an interior passage for coupling water under pressure from the flexible hose to the interior of the spray head. The spray head is elongated and defines angled facets each having a plurality of spray apertures formed therein. A valve slide shaped in correspondence to the interior of the spray head is slidably movable within the spray head. The valve slide defines a plurality of apertures corresponding to the apertures formed in the spray body. Volume of spray adjustment is controlled by the position of the valve slide with respect to the spray body. The angled facets of the spray head and aperture placement are configured to provide a hygiene device for cleaning the rectal area.

8 Claims, 2 Drawing Sheets

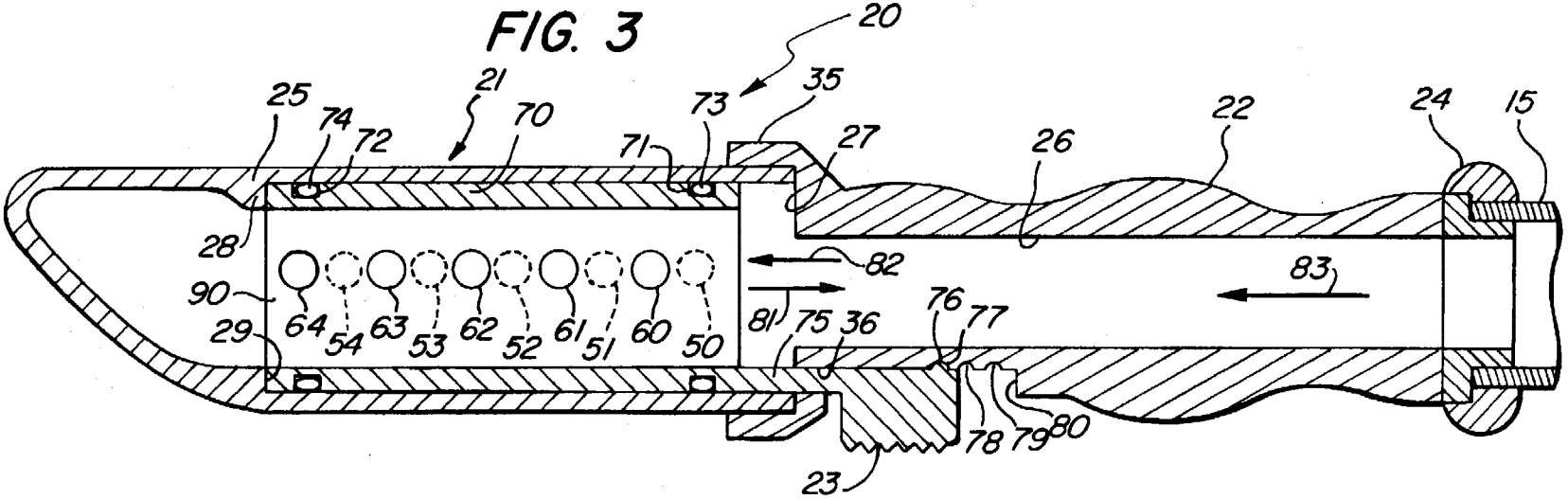
FIG. 3
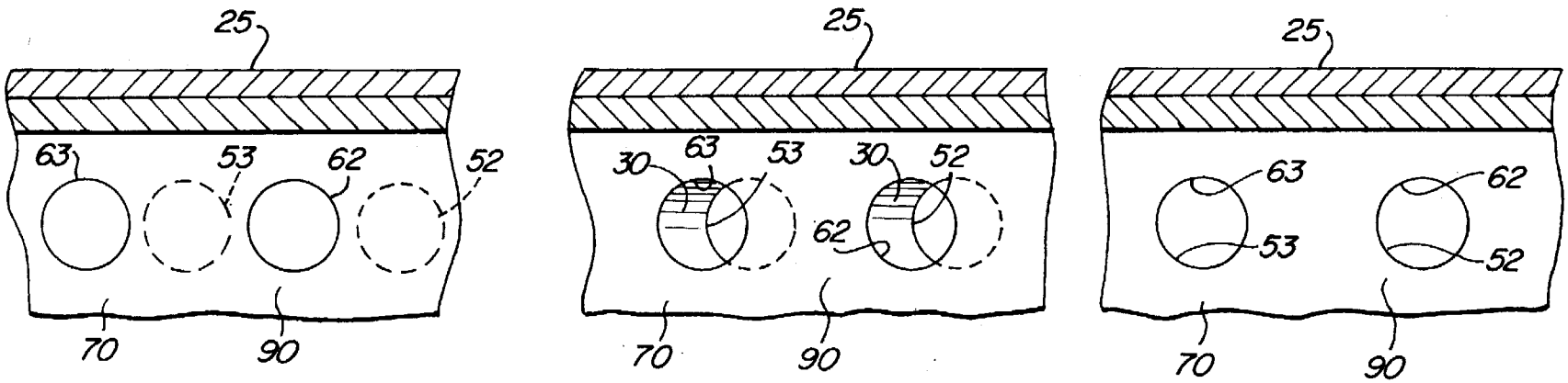
FIG. 4A
FIG. 4B
FIG. 4C

RECTAL AREA HYGIENE DEVICE

FIELD OF THE INVENTION

This invention relates generally to personal hygiene and particularly to washing and cleansing devices used in connection therewith.

BACKGROUND OF THE INVENTION

One of the most pervasive and widely used personal hygiene and washing devices is that typically known as a shower. Such showers are provided in virtually all personal bathing areas such as private residences, public hotel facilities, health clubs, spas and gymnasiums. While the particular structural aspects of showers vary somewhat, generally all may be said to include a bathing area or shower stall or cubicle within which a supply of water spray is available. Typically, the force and temperature of the water spray is adjustable to suit the needs of the user. The user having adjusted the water spray to preference then simply stands beneath the spray source and carries forward washing and rinsing of outer body areas.

The most typical shower facility provided within the United States includes an overhead spray source which is often adjustable as to force and spray pattern. Other variations are provided in the form of pulsating sprays for massaging application or the like. In some shower facilities within the United States, an addition handheld spray head is provided which is coupled to the water source by a flexible tube and which may be either fixedly mounted using a bracket upon the shower wall or held in the user's hand allowing spray to be variously directed at body areas.

Shower facilities found in other parts of the world and particularly in certain countries in Europe further provide shower facilities which have pluralities of spray nozzles situated upon the sidewalls of the shower facility. The sidewall sprays provide a more generally distributed and often more effective cleansing and rinsing spray. In addition, certain toilet facilities within European countries often provide a device known generally as a bidet. The function of the bidet is to provide an upwardly directed water spray within a toilet seating facility which operates to provide cleansing of the user's rectal and genital areas.

Despite considerable variation of showers and personal hygiene devices, the rectal area of bathers is often ignored. Proper hygiene and sanitation in this critical body area is known by medical practitioners to be important for overall body health. A variety of ailments and diseases are effectively combatted or minimized if users properly maintain hygiene in their rectal areas. Unfortunately for a variety of reasons which include custom as well as limitations in the effectiveness of the above described prior art shower and hygiene devices, this body area continues to be overlooked and improperly bathed. Conventional showers simply do not provide the required spray pattern and direction for proper rectal area hygiene. Handheld sprayers of the type referred to above are a definite improvement over fixed head sprayers but are often too large and clumsy and usually fail to provide the required spray pattern for maximum effectiveness. Similarly, side spray showers of the type referred to above and generally used in Europe are subject to the same limitations of poorly directed improper spray patterns for proper rectal hygiene.

There remains therefore a continuing need in the art for more improved personal hygiene devices which are properly suited to maintaining and cleaning the rectal area. There remains a further need in the art for a rectal hygiene devices which, by virtue of ease of use and convenience, is more likely to gain acceptance and effective use on the part of a large number of users.

SUMMARY OF THE INVENTION

Accordingly, it is a general object of the present invention to provide an improved rectal area hygiene device. It is a more particular object of the present invention to provide an improved rectal area hygiene device which overcomes the limitations and shortcomings of prior art devices and which is easy to use and manipulate within the limited space within a typical shower stall. It is a still further object of the present invention to provide an improved rectal area hygiene device which requires a minimum of alteration of an existing shower facility of the type typically found in the United States.

In accordance with the present invention, there is provided for use in a shower facility having a supply of water, a rectal hygiene device comprising: means for coupling to the supply of water; a flexible hollow hose having a first end coupled to the means for coupling and a second end; a handle having a passage therethrough coupled to the second end; and a spray head, having an elongated spray body defining a plurality of spray apertures therein, coupled to the handle, the spray head providing an elongated water spray pattern for cleaning the user's rectal area.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 3 sets forth a full section view of the spray head and support handle of the present invention rectal area hygiene device;

FIGS. 4A through 4C set forth respective partial views of the spray control portion of the present invention rectal area hygiene device.

DESCRIPTION OF THE PREFERRED EMBODIMENT

Figure 1:
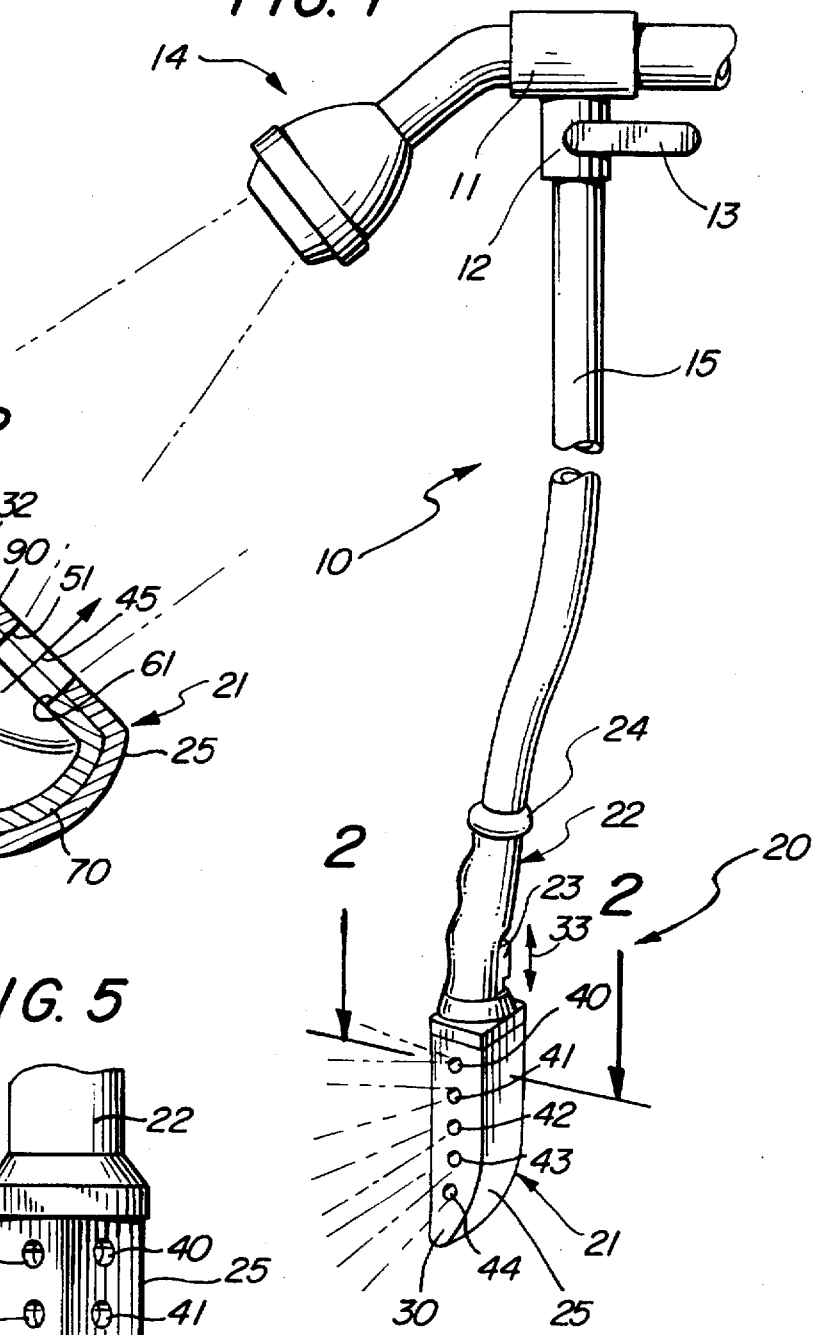
FIG. 1 sets forth a side view of a rectal area hygiene device constructed in accordance with the present invention installed in a typical shower facility.
Figure 5:
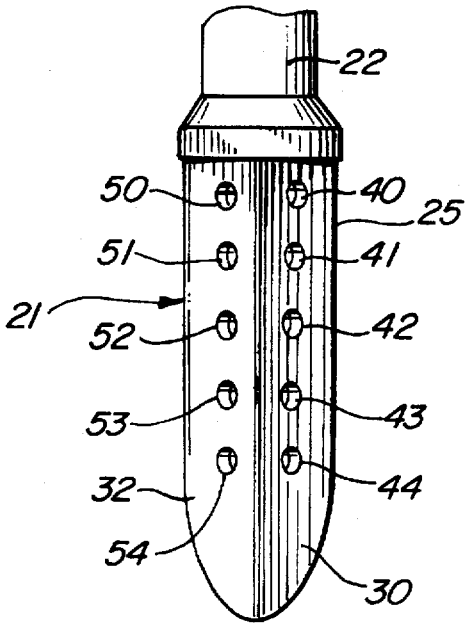
FIG. 5 sets forth a partial front view of the spray head of the present invention rectal area hygiene device.

FIG. 1 sets forth a side elevation view of a hygiene device constructed in accordance with the present invention and generally referenced by numeral 10. Hygiene device 10 includes a conventional tee fitting 11 secured within the water supply line of a conventional shower head generally referenced by numeral 14. In further accordance with conventional fabrication techniques, tee 11 includes a valve 12 having a handle 13 which is coupled to an elongated flexible tubular hose 15. Hygiene device 10 further includes a head assembly 20 having an elongated handle 22 secured to flexible hose 15 by a fitting 24. Head assembly 20 further includes a spray head 21 secured to handle 22. Spray head 21 includes an elongated spray body 25 having a pair of angled faces 30 and 32 (the latter seen in FIG. 5). As is also seen in FIG. 5, faces 30 and 32 define a plurality of spray apertures 40 through 44 and 50 through 54 respectively. By means set forth below in greater detail, a spray adjustment button 23 is movably supported upon handle 22 and is operative in accordance with the structure set forth below to adjust the spray volume through apertures 40 through 44 and 50 through 54. Suffice it to note here that spray adjust button 23 is movable in the manner indicated by arrows 33 to adjust the water spray volume emanating from spray head 21.

In accordance with the anticipated use of the present invention hygiene device, the user adjusts the temperature of water supplied to shower head 14 using conventional hot and cold mixture apparatus (not shown). Thereafter, the user is able to close valve 12 by positioning handle 13 as shown and utilize shower head 14 for conventional shower activity. Additionally and in accordance with the present invention, the user may then turn handle 13 opening valve 12 and allowing water to flow through flexible hose 15 and an interior passage within handle 22 shown in FIG. 3. The water flow then continues into the interior of spray head 21 and is forced outwardly by water pressure through spray apertures 40 through 44 in face 30 and 50 through 54 in face 32 (the latter seen in FIG. 5). The plurality of water jets flowing outwardly from the spray apertures within spray body 25 provides a spray pattern ideally suited to attending to hygiene of the user's rectal area. In addition, the angled disposition of faces 30 and 32 (better seen in FIG. 2) facilitates the close positioning of spray body 25 in the rectal area of the user. Throughout the washing activity, handle 22 provides for easy manipulation of spray head 21. In addition, in its preferred form, flexible hose 15 is sufficiently flexible and sufficient in length to provide easy manipulation of spray head 21 and extension to or below the typical rectal area of the user. In accordance with the apparatus set forth below in FIGS. 3 and 4A through 4C, the positioning of spray adjust button 23 provides for the desired spray intensity. In addition, the convenient location of spray adjust button 23 upon handle 22 facilitates spray volume adjustment and spray head manipulation using a single hand. This is extremely important in the use of the present invention hygiene device by many persons who must maintain a free hand for steadying and balancing to avoid falling while showering. Of particular importance in maintaining a free hand is the use by hygiene device 10 in the hands of older persons, physically impaired persons or younger children where substantial interest in avoiding dangerous falls exists.

Figure 2:
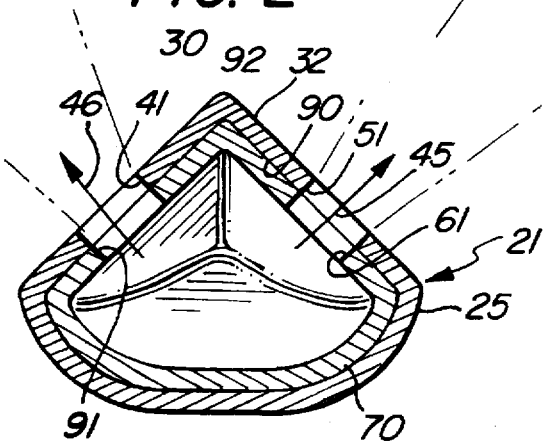
FIG. 2 sets forth a section view of the head portion of the present invention rectal area hygiene device taken along section lines 2—2 in FIG. 1.

FIG. 2 sets forth a section view of spray head 21 taken along section lines 2—2 in FIG. 1. Spray head 21 includes a spray body 25 defining angled faces 30 and 32. The remainder or back portion of body 25 defines a generally curved surface. Spray head 21 further includes a valve slide 70 having a cross-section shape corresponding to the interior surfaces of spray body 25. Accordingly, valve slide 70 defines a pair of generally angled faces 90 and 92 fitted against the interior surfaces of faces 30 and 32 respectively. Faces 90 and 92 of valve slide 70 are angled in correspondence to the angle formed between faces 30 and 32 of body 25. Further, valve slide 70 defines a curved rear portion which conforms to the interior surface of the curved rear portion of body 25. Thus, in the manner set forth below in greater detail, valve slide 70 is slidable within spray body 25. As described above, spray body 25 defines a row of spray apertures 40 through 44 on face 30 and 50 through 54 on face 32. Correspondingly, valve slide 70 defines a corresponding plurality of spray apertures formed in each of faces 90 and 92. With temporary reference to FIG. 3, apertures 60 through 64 formed in face 90 are shown in correspondence to apertures 50 through 54 in face 30 of spray body 25.

Returning to FIG. 2, with valve slide 70 aligned in the fully open position shown in FIG. 2, each respective aperture formed in valve slide 70 is aligned with its corresponding aperture formed in spray body 25. As a result, water forced into the interior of spray head 21 is forced outwardly through the aligned apertures forming outwardly directed water sprays. In the example shown in FIG. 2, apertures 61 and 51 of valve slide 70 and spray body 25 are aligned allowing water to flow outwardly in the direction indicated by arrow 45. Similarly, on the opposite side of spray side 21, the alignment of aperture 91 in valve slide 70 and aperture 41 in spray body 25 allows water flow outwardly in the direction indicated by arrow 46. While not seen in FIG. 2, it will be understood by those skilled in the art that once valve slide 70 is aligned in the manner described below to provide the fully open position, corresponding water jets are forced outwardly through each of the apertures formed in valve slide 70 and spray body 25.

FIG. 3 sets forth a section view of head assembly 20 shown coupled to flexible hose 15 by a conventional fitting 24. As described above, head assembly 20 includes a handle 22 secured to a spray head 21. Handle 22 defines an interior passage 26 which permits water flow from flexible hose 15 into spray head 21 in the direction indicated by arrow 83. Handle 22 further defines an extending collar 35 which receives spray body 25. Collar 35 is joined to spray body 25 using conventional attachment techniques such as frictional fit or adhesive bonding or the like. Handle 22 further defines an interior wall 27 which receives the interior end of spray body 25. As described above, spray body 25 defines a pair of angled faces 30 and 32 which define respective rows of spray apertures 40 through 44 and 50 through 54 respectively (seen in FIG. 5). Thus, in the section view of FIG. 3, spray body 25 defines a row of spray apertures 50 through 54 shown in dashed-line representation due to the interposition of a valve slide 70. As is described above and shown in FIG. 2, valve slide 70 is slidably supported within spray body 25 and is shaped in substantial conformity to the interior surfaces of spray body 25. Thus, in the section view shown in FIG. 3, valve slide 70 is shown to include a face 90 defining a plurality of spray apertures 60 through 64. As will be seen, apertures 60 through 64 in face 90 of valve slide 70 are positioned and spaced in substantial conformity to apertures 50 through 54 in spray body 25.

Valve slide 70 further includes a slide arm 75 extending outwardly through an aperture 36 formed in handle 22. Slide arm 75 is joined to an adjustment button 23 which is slidably movable between the position shown in FIG. 3 and a fully retracted position abutting stop 80 formed in handle 22. Adjustment button 23 further includes a detent projection 76 extending inwardly toward handle 22. Correspondingly, a plurality of detent recesses 77, 78 and 79 are formed on the mating surface of handle 22 and receive detent projection 76 as adjustment button 23 is moved. Spray body 25 further defines a pair of stop surfaces 28 and 29 which limit the forward motion of valve slide 70 within spray body 25. Thus, valve slide 70 is slidably movable within spray body 25 between the fully forward position shown in FIG. 3 and a fully withdrawn position in which adjustment button 23 abuts stop 80 and detent projection 76 is received within detent recess 79. Valve slide 70 further defines a pair of grooves 71 and 72 which receive a pair of annular resilient seals 73 and 74 respectively. Seals 73 and 74 provide fluid tight seal between valve slide 70 and spray body 25.

The spray volume adjustment referred to above is provided by positioning adjustment button 23 with respect to handle 22 in the following manner. With adjustment button 23 positioned as shown in FIG. 3 such that detent projection 76 is received within detent recess 77, valve slide 70 is positioned forwardly within spray body 25 and abuts stops 28 and 29 formed therein. With valve slide 70 thus positioned, apertures 60 through 64 formed in valve slide 70 are offset with respect to apertures 50 through 54 formed in spray body 25. As a result, water under pressure introduced into spray head 21 through passage 26 of handle 22 is prevented from traveling outwardly through apertures 50 through 54. It will be understood by those skilled in the art that the positioning of a second row of apertures formed in face 92 of valve slide 70 with respect to apertures 50 through 54 of spray body 25 is substantially the same as shown in FIG. 3. Thus, none of the apertures formed in valve slide 70 is aligned with or overlying any of the corresponding apertures formed in spray body 25. Thus, complete closure of spray body 25 is provided with adjustment button 2!3 in the position shown in FIG. 3.

This complete closure position of valve slide 70 is shown in FIG. 4A in which the offset of apertures formed in valve slide 70 from apertures formed in spray body 25 is shown. As the user moves adjustment button 23 in the direction indicated by arrow 81, valve slide 70 is correspondingly moved with respect to spray body 25. In accordance with this motion, the pluralities of apertures in valve slide 70 are moved toward the respective pluralities of apertures formed in spray body 25. Once the apertures of valve slide 70 and spray body 25 begin to overlap in the manner seen in FIG. 4B, water under pressure within spray head 21 is allowed to spray outwardly. The volume of water spray outwardly through the apertures formed in spray body 25 is proportional to the degree of overlap between the apertures formed in valve slide 70 and the apertures formed in spray body 25. Thus, as the user moves adjustment button 23 toward stop 80, greater overlap and alignment of apertures between valve slide 70 and spray body 25 is produced causing corresponding increases in the spray volume proceeding outwardly from spray head 21. With adjustment button 23 fully withdrawn against stop 80 and detent projection 76 received within detent recess 79, a virtual overlap of apertures of valve slide 70 and spray body 25 occurs resulting in the alignment of apertures shown in FIG. 4C which produces maximum spray volume. Thus, as the user moves adjustment button 23 in the direction indicated by arrow 82, spray volume is reduced or closed off and, conversely, as the user moves adjustment button 23 in the direction indicated by arrow 81, spray volume is increased or maximized.

FIGS. 4A through 4C set forth exemplary positioning of apertures within valve slide 70 and spray body 25 during the above-described spray volume adjustment. In each figure, valve slide 70 is shown having apertures 62 and 63 formed therein while spray body 25 is shown having corresponding apertures 52 and 53 formed therein. In FIG. 4A, the apertures of valve slide 70 and spray body 25 are fully offset and thus no water flow is provided. In FIG. 4B, valve slide 70 is positioned such that its apertures such as apertures 62 and 63 partially align with apertures 52 and 53 of spray body 25. As a result, a partial opening or flow aperture is produced. Finally, in FIG. 4C, valve slide 70 is positioned such that its apertures are aligned with each respective aperture formed in spray body 25. This provides the maximum spray volume. It will be apparent to those skilled in the art that a variety of intermediate positions between the cutoff position of FIG. 4A and the full alignment position of FIG. 4C may be utilized to control flow volume.

FIG. 5 sets forth a partial front view of spray head 21 showing spray body 25 secured to handle 22. Spray body 25 defines angled faces 30 and 32. Face 30 defines a row of spray apertures 40 through 44 while face 32 defines a corresponding row of apertures 50 through 54. The angular relationship between faces 30 and 32 is selected together with the spray pattern of apertures 40 through 44 and 50 through 54 to provide the desired spray pattern for effective hygiene.

It will be apparent to those skilled in the art that while the preferred embodiment of the present invention shown in FIG. 1 utilizes a valve 12 and handle 13 supported on tee 11 together with a spray adjustment button 23 and the above-described valve slide to control spray volume, either apparatus utilized alone will provide effective spray volume control. Thus, for example, in an alternate configuration of the present invention, valve slide 70 may be eliminated and the user may rely completely upon valve 12 and handle 13 for spray volume adjustment. Conversely, a simple tee may be utilized in place of tee 11 without valve 12 and handle 13 in an alternative arrangement in which the user relies entirely upon spray adjustment using valve slide 70 in the manner described. It will be further evident to those skilled in the art that other apparatus for regulating and adjusting the spray volume may be utilized in the present invention structure.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in a shower facility having a supply of water, a rectal hygiene device comprising:

means for coupling to said supply of water;

a flexible hollow hose having a first end coupled to said means for coupling and a second end;

a handle having a passage therethrough coupled to said second end; and a spray head, having an elongated spray body defining a plurality of spray apertures therein, coupled to said handle, said spray body further defining a pair of angled faces, said spray apertures being arranged in rows thereon;

a slide valve movable within said spray body and having a plurality of valve apertures corresponding to said spray apertures, said valve slide being movable to offset or align or partially align said valve apertures with said spray apertures, said spray head providing an elongated water spray pattern for cleaning the user's rectal area.

2. A rectal hygiene device as set forth in claim 1 wherein said valve slide includes an extending arm having a button supported thereon.

3. A rectal hygiene device as set forth in claim 2 further including detent means for detentably positioning said valve slide with respect to said spray body.

4. A rectal hygiene device as set forth in claim 3 further including a flow control valve supported within said means for coupling.

5. For use in a bathing facility having a water supply, a rectal hygiene device comprising:

a spray head having an elongated closed-end spray body defining an open end, an interior closed-end cavity and a pair of elongated angled faces, each face defining a plurality of spray apertures for providing an elongated water spray pattern for cleaning the user's rectal area, said spray head further including a valve slide movable within said spray body and having a plurality of valve apertures corresponding to said spray apertures, said valve slide being movable to offset or align or partially align said valve apertures with said spray apertures;

an elongated handle having a first end coupled to said open end of said spray body, a second end and a passage therethrough;

an elongated flexible hollow hose adapted for coupling said second end of said handle to said water supply.

6. A rectal hygiene device as set forth in claim 5 wherein said valve slide includes an extending arm having a button supported thereon.

7. A rectal hygiene device as set forth in claim 6 further including detent means for detentably positioning said valve slide with respect to said spray body.

8. A rectal hygiene device as set forth in claim 7 further including a flow control valve supported within said means for coupling.

* * * * *